US007997694B2

(12) United States Patent
Nomura et al.

(10) Patent No.: US 7,997,694 B2
(45) Date of Patent: Aug. 16, 2011

(54) INKJET RECORDING APPARATUS

(75) Inventors: Yuko Nomura, Kawasaki (JP); Isao Amemiya, Machida (JP); Kazuhiko Higuchi, Kawasaki (JP); Kenichi Mori, Yokohama (JP)

(73) Assignee: Kabushiki Kaisha Toshiba, Tokyo (KP)

( * ) Notice: Subject to any disclaimer, the term of this patent is extended or adjusted under 35 U.S.C. 154(b) by 905 days.

(21) Appl. No.: 11/902,445

(22) Filed: Sep. 21, 2007

(65) Prior Publication Data

US 2009/0115820 A1 May 7, 2009

(30) Foreign Application Priority Data

Sep. 26, 2006 (JP) ..... P2006-261459

(51) Int. Cl.
*B41J 2/045* (2006.01)

(52) U.S. Cl. ..... 347/70

(58) Field of Classification Search ..... 347/70
See application file for complete search history.

(56) References Cited

U.S. PATENT DOCUMENTS

| | | | |
|---|---|---|---|
| 4,751,534 | A | 6/1988 | Elrod et al. |
| 5,686,945 | A | 11/1997 | Quate et al. |
| 6,036,301 | A | 3/2000 | Amemiya et al. |
| 6,045,208 | A | 4/2000 | Hirahara et al. |
| 6,474,783 | B1 | 11/2002 | Pilossof et al. |
| 2002/0044171 | A1 | 4/2002 | Hirahara et al. |
| 2004/0189748 | A1 | 9/2004 | Amemiya |
| 2006/0144871 | A1 | 7/2006 | Van Tuyl et al. |

FOREIGN PATENT DOCUMENTS

| | | | |
|---|---|---|---|
| CN | 1117436 | | 2/1996 |
| EP | 0 272 155 | | 12/1987 |
| EP | 0 572 241 | B1 | 12/1993 |
| EP | 1 008 451 | A2 | 6/2000 |
| EP | 0 692 383 | B1 | 6/2005 |
| JP | 63 166547 | | 7/1988 |
| JP | 2-133341 | | 11/1990 |
| JP | 3-155953 | | 7/1991 |
| JP | 6-91890 | | 4/1994 |
| JP | 6-238884 | | 8/1994 |
| JP | 8-99408 | | 4/1996 |
| JP | 11-235820 | | 8/1999 |
| JP | 11-254666 | | 9/1999 |
| JP | 2000-168090 | | 6/2000 |
| JP | 3432934 | | 5/2003 |
| JP | 3466783 | | 8/2003 |
| JP | 3471958 | | 9/2003 |
| JP | 2005-270929 | | 10/2005 |

OTHER PUBLICATIONS

Office Action issued by the Japanese Patent Office on Aug. 12, 2008, for Japanese Patent Application No. 2006-261459, and English-language Summary thereof.

*Primary Examiner* — Jerry T Rahll
(74) *Attorney, Agent, or Firm* — Finnegan, Henderson, Farabow, Garrett & Dunner, L.L.P.

(57) ABSTRACT

An inkjet recording apparatus includes: an ink holding chamber having a through hole to jet ink, and holding the ink; and a head unit jetting the ink held in the ink holding chamber from the through hole. The head unit includes an ultrasonic wave generation member, an ultrasonic wave focusing member focusing the ultrasonic waves generated at the ultrasonic wave generation member in a vicinity of the through hole, an ultrasonic wave propagation portion propagateting the ultrasonic waves leaving the ultrasonic wave focusing member, and a container portion containing the ultrasonic wave generation member, the ultrasonic wave focusing member, and the ultrasonic wave propagation portion.

5 Claims, 6 Drawing Sheets

INKJET RECORDING APPARATUS

CROSS-REFERENCE TO RELATED APPLICATIONS

This application is based upon and claims the benefit of priority from the prior Japanese Patent Application No. 2006-261459, filed on Sep. 26, 2006; the entire contents of which are incorporated herein by reference.

BACKGROUND OF THE INVENTION

1. Field of the Invention

The present invention relates to an inkjet recording apparatus recording images on a recording medium by ejecting ink droplets, and in particular, to an inkjet recording apparatus in which ultrasonic waves are generated from an ultrasonic wave generation member, and the ultrasonic waves are focused to eject the ink droplets.

2. Description of the Related Art

An inkjet recording apparatus recording images by ejecting liquid ink as small droplets on a recording medium has a lot of advantages such that a direct recording on a plain paper and so on is possible, a low cost in an aspect of material consumption such as ink is realized, less noise, processes such as development, fixing, are not necessary. Accordingly, in recent days, utilization range is broaden out into industrial field such as a coating of a liquid electronic material, and a direct patterning, in addition to an application of printing images on a paper and so on.

Many methods are devised as the inkjet recording apparatus, but in particular, a method in which the droplets are ejected by using pressure of bubbles generated by heat of a heating element, a method in which droplets are ejected by a pressure pulse resulting from a displacement of a piezoelectric material, and so on are representatives.

However, there has been a problem that the ejecting of the ink droplets is disturbed because a concentration of ink is easy to occur caused by evaporation, volatile of the liquid ink solvent and a clogging occurs when a nozzle with a small diameter is used, in the inkjet recording apparatus in the above stated methods. Accordingly, it is necessary to provide an additional means such as a cleaning of the nozzle to prevent the clogging of the nozzle for a particularly high definition image recording, and the utilization range thereof has been limited such that a requirement to select and use an ink material with less clogging occurrences rises. Besides, a method in which fine ink drops are ejected without using a nozzle by vibrating a resilient member immersed in the ink by using the piezoelectric material so that the ink drops are ejected from a tip portion of the resilient member by the vibration, is known as the other method (for example, refer to JP-A 11-235820).

On the other hand, an ultrasonic type apparatus in which ultrasonic waves generated from an oscillator are focused and the droplets are ejected from a liquid surface by a sound pressure thereof is proposed (for example, refer to JP-A 2005-270929). Besides, an apparatus in which the ultrasonic method, focusing the ultrasonic waves generated from the oscillator and ejecting the droplets from the liquid surface by using the sound pressure, is used and constituted as a phased array head is also proposed (for example, refer to JP-A 8-99408). The above-stated ultrasonic method does not require the nozzle, being capable of ejecting the ink drops with very small diameter, and is suitable for high resolution recording. Besides, there is an advantage of less restriction for the usable ink and so on.

However, there are problems such that a large power is required to eject the ink drops because the ultrasonic waves are attenuated before the ultrasonic waves reach a focus point when ink with a large ultrasonic wave attenuation is used, or the ink drops cannot be ejected when the ink with the large attenuation is used, even though there is less restriction in the ink material and so on. Accordingly, an art is also known in which the ink is pressure-fed via a pore and so on, a thin layer of ink is formed on a surface of an ultrasonic wave propagation material to eject the ink from the thin film (for example, refer to JP-A 6-91890).

However, in the above-stated conventional art, the ink is supplied via the pore and soon, and therefore, the pressure is required to feed the ink, and there is a problem that it is difficult to supply the ink evenly to a whole head. Besides, there also is a problem that it is difficult to realize a stable ejecting caused by a liquid surface fluctuation of ink resulting from the ejecting of ink or the evaporation of ink.

SUMMARY OF THE INVENTION

An object of the present invention is to provide an inkjet recording apparatus capable of easily and evenly supplying ink and stably performing a good recording compared to the conventional way in addition that the ink with large ultrasonic wave attenuation can be used and so on.

According to an aspect of the present invention, an inkjet recording apparatus is provided, including an ink holding chamber having an opening portion and holding the ink inside thereof, and a head unit ejecting the ink held in the ink holding chamber from the opening portion, wherein the head unit includes: an ultrasonic wave generation member to generate ultra sonic waves; a focusing member to focus the ultrasonic waves in a vicinity of the opening portion; an ultrasonic wave propagation portion propagating the ultrasonic waves leaving the ultrasonic wave focusing member; and a container portion containing the ultrasonic wave generation member, the ultrasonic wave focusing member and the ultrasonic wave propagation portion.

DESCRIPTION OF THE EMBODIMENTS

Figure 1:
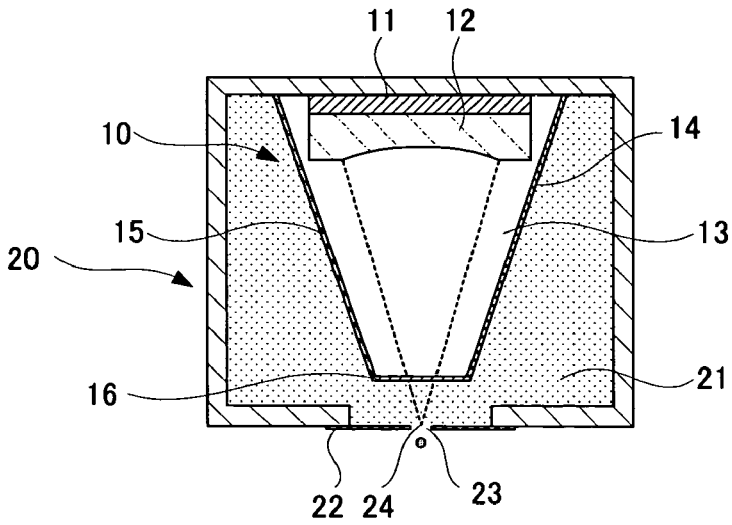
FIG. 1 is a sectional view of a single head portion according to a first embodiment of the present invention.

Hereinafter, embodiments of the present invention are described with reference to the drawings. FIG. 1 is a sectional view of a single head of an inkjet recording apparatus according to a first embodiment, and FIG. 2 is a perspective view of the single head of the inkjet recording apparatus according to the first embodiment.

Figure 2:
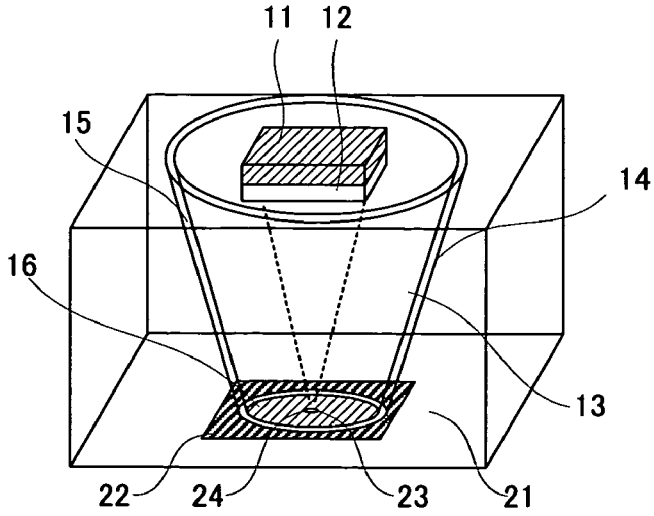
FIG. 2 is a perspective view of the single head portion shown in FIG. 1.

As shown in FIG. 1 and FIG. 2, the inkjet recording apparatus according to the present embodiment has an ink chamber 20 and a head unit 10 provided inside of the ink chamber 20. This head unit 10 includes an ultrasonic wave generation member 11, an ultrasonic wave focusing member 12, an ultrasonic wave propagation portion 13, and a container portion 14 housing the above inside thereof.

An ink holding chamber 21 holding ink is provided inside of the ink chamber 20. Besides, a slit plate 22 is provided at a part of the ink chamber 20. The slit plate 22 includes a through hole (opening portion) 23, and the ink held in the ink holding chamber 21 is ejected from this through hole 23.

The ultrasonic wave generation member 11 is constituted by a not-shown piezoelectric material, electrode and so on. Piezoceramics such as lead zirconate titanate (PZT), lead titanate and barium titanate, piezoelectric single crystals such as lithium niobate and lithium tantalite, a polymeric piezoelectric material such as polyvinylidene fluoride (PVDF), and piezoelectric semiconductor such as zinc oxide and so on can be used as the piezoelectric material. For example, Au/Ti, Au/Cr, Al, and so on can be used as the electrode. Besides, a not-shown drive circuit driving the piezoelectric material to generate ultrasonic waves is connected to the not-shown electrode, and the drive circuit drives the piezoelectric material to generate the ultrasonic waves based on an image recording data propagated from external.

The ultrasonic wave focusing member 12 is disposed on the ultrasonic wave generation member 11 so as to focus the ultrasonic waves generated at the ultrasonic wave generation member 11 into an ultrasonic wave focus point 24 in a vicinity of the through hole 23 of the slit plate 22 provided at a part of the ink chamber 20. A meniscus is formed on a liquid surface of the ink held in the ink holding chamber 21 by a pressure of an ultrasonic beam focused by the ultrasonic wave focusing member 12, and ink droplets are separated to eject. In FIG. 1, an example in which a circular concave lens is used as the ultrasonic wave focusing member 12 is shown. A concave portion of the circular concave lens may be a curved surface having a simple curvature, but an aspherical lens designed so that a spherical aberration caused by refraction is corrected to focus the ultrasonic wave at a predetermined position may be used.

As a material of the ultrasonic wave focusing member 12, for example, an inorganic material such as glass, and an epoxy resin and so on can be used. Besides, it may be the material in which a surface treatment such as a metal film, metallic oxide film, nitride film, polyolefin resin film is performed on a surface of the glass or the resin to improve durability thereof. An ultrasonic impedance of the ultrasonic wave focusing member 12 is desirable to be an intermediate value between the ultrasonic impedance (ZP) of the piezoelectric material used at the ultrasonic wave generation member 11 and a later-described ultrasonic impedance (ZL) of the ultrasonic wave propagating portion 13, and to be near a geometric average $(ZP \cdot ZL)^{1/2}$ for an effective propagation of the ultrasonic wave. Besides, as the ultrasonic wave focusing member 12, for example, a Fresnel lens based on a Fresnel zone theory may be used.

The ultrasonic wave propagation portion 13 is a portion in which the ultrasonic waves generated at the ultrasonic wave generation member 11 and focused by the ultrasonic wave focusing member 12 travels, and an ultrasonic wave propagation material is filled therein. As the ultrasonic wave propagation material, the one with small ultrasonic wave attenuation is preferable, and for example, water is suitable. However, the ultrasonic wave propagation material is not necessarily be liquid, but a solid body ultrasonic wave propagation material can be used.

The container portion 14 contains the ultrasonic wave generation member 11, the ultrasonic wave focusing member 12, and the ultrasonic wave propagation portion 13. This container portion 14 is practically fixed, and constituted by a sidewall 15 disposed approximately in parallel with a traveling direction in which the ultra sonic wave leaving the ultra sonic wave focusing member 12 travels, and a variable shaped isolation film 16. Besides, the container portion 14 has a shape in which a horizontal cross-sectional shape is circular, and a tip portion side (lower side in FIG. 1 and FIG. 2) becomes thin (truncated conical shape) in examples shown in FIG. 1 and FIG. 2, but the shape of the container portion 14 may be any shape such as, for example, a column shape, a prismatic shape as long as a cross-sectional area in a lateral direction is larger than a traveling path of the ultrasonic wave. However, it is preferable to be a shape in which an area of a narrow portion (tip portion) between the isolation film 16 and the slit plate 22 becomes small with considering a supply of the ink inside of the ink holding chamber 21. A material constituting the sidewall 15 may be any material as long as it has stiffness, but it is preferable to use a material which is difficult to reflect the ultrasonic wave, and for example, a porous ceramic is used.

The isolation film 16 positions on the traveling path of the ultrasonic waves generated at the ultrasonic wave generation member 11, is provided so as to face the through hole 23, and constituted by a thin film (for example, film thickness of 5 μm to 20 μm) of which shape is changeable. A material composing the isolation film 16 may be any one which propagates the ultrasonic wave and the shape thereof is changeable, and for example, polyethylene terephthalate (PET) is used. The film thickness of the isolation film 16 is preferable to be a degree not to make the ultrasonic wave attenuation large, and more preferable to be a wavelength of the ultrasonic wave generated at the ultrasonic wave generation member 11 or less. This isolation film 16 deforms to thereby enabling an adjustment of a position of an ultrasonic wave focus point 24. The detail will be described later.

In the above-stated first embodiment, the ultrasonic waves generated at the ultrasonic wave generation member 11 and focused by the ultrasonic wave focusing member 12 is propagated until in the vicinity of the ultrasonic wave focus point 24 by the ultrasonic wave propagation portion 13. Accordingly, it is possible to suppress an influence even when the ink having the large ultrasonic wave attenuation is used, and to eject the ink drops with less power. Besides, as shown in FIG. 1, a height of the head unit 10 provided inside of the ink chamber 20 relative to the ultrasonic wave traveling direction is constituted to be smaller than a depth of the ink chamber 20 in a parallel direction with the ultrasonic wave traveling direction inside of the ink chamber 20. Consequently, the ink of the ink holding chamber 21 inside of the ink chamber 20 is supplied to the ultrasonic wave focus point 24 not via a pore and so on, and therefore, it becomes possible to supply ink easily and evenly, and to perform a good and stable recording. Incidentally, when a supply series of ink of the ink holding chamber 21 is not provided, the ink filled in the ink chamber 20 decreases little by little by the ejecting of the ink droplets. Accordingly, an exchange becomes necessary at the time when a liquid surface of the ink becomes lower than the isolation film 16.

Figure 3:
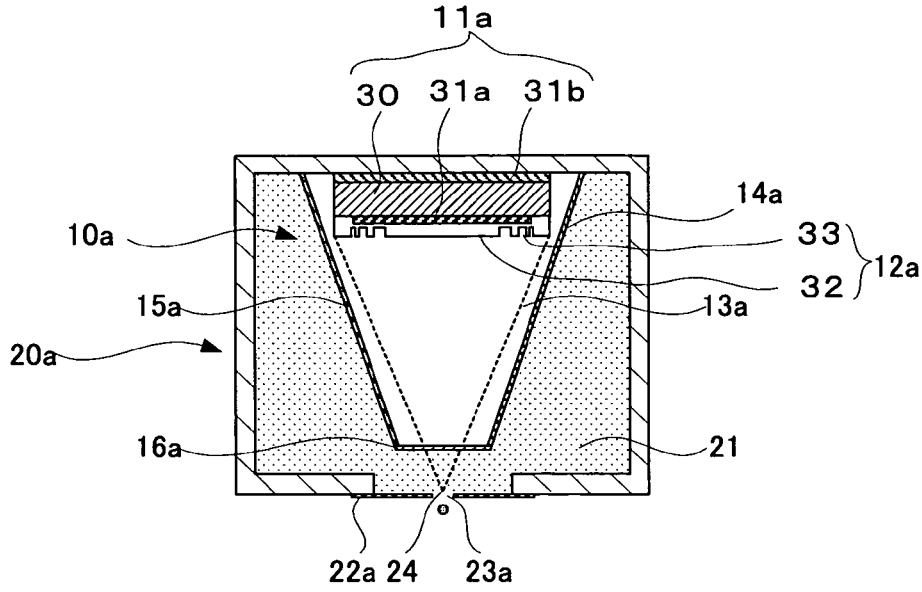
FIG. 3 is a sectional view of a phased array head portion according to a second embodiment of the present invention.
Figure 4:
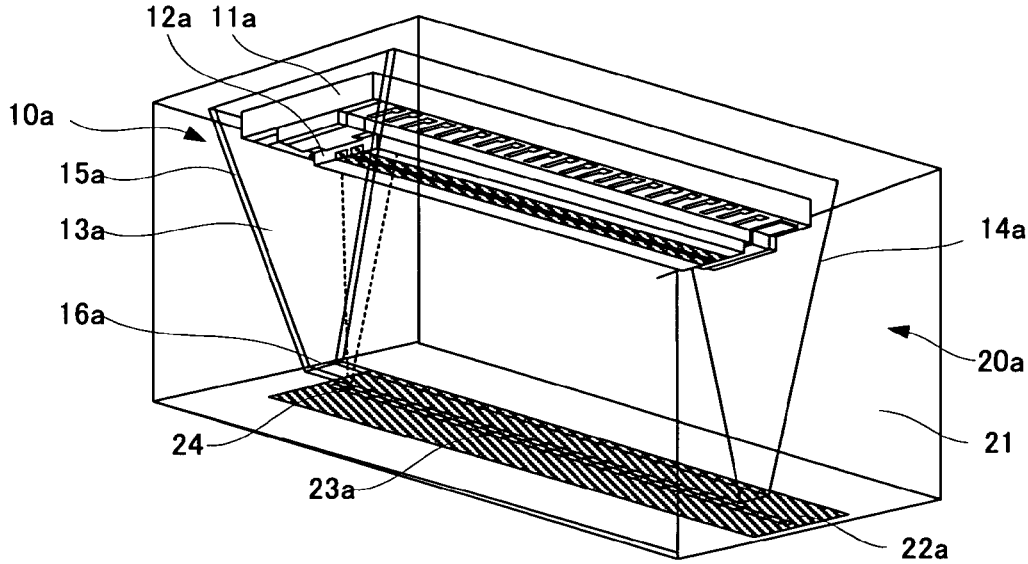
FIG. 4 is a perspective view of the phased array head portion shown in FIG. 3.

FIG. 3 and FIG. 4 are views showing a configuration of a second embodiment in which the above-stated first embodiment is applied to a head called as a phased array. FIG. 3 is a sectional view, and FIG. 4 is a perspective view. Components of a head unit 10*a* are the same as the first embodiment, but the following points are different from the first embodiment that an ultrasonic wave generation member 11*a* is constituted by piezoelectric materials 30 and electrodes 31*a*, 31*b* disposed in one-dimensional array state, and an ultrasonic wave focusing member 12*a* is a flat Fresnel lens in which grooves 33 are cut on a glass 32. Besides, respective shapes of an ultrasonic wave propagation portion 13*a*, a container portion 14*a*, a sidewall 15*a*, an isolation film 16*a*, an ink chamber 20*a*, a slit plate 22*a*, and a through hole 23*a* are different from the first embodiment to suit to the above-stated shapes as shown in FIG. 4. The present invention can be applied to a phased array head as in the second embodiment, and operations and effects as same as the first embodiment can be obtained.

Incidentally, in the second embodiment, the shape of the container portion 14*a* of the head unit 10*a* is the shape of which tip portion side (lower side in FIG. 3 and FIG. 4) becomes narrow as shown in FIG. 3 and FIG. 4, but the shape may be the one of which tip portion side does not become narrow. However, with considering the supply of ink, the shape is preferable to be the one in which an area of the narrow portion (tip portion) between the isolation film 16*a* and the slit plate 22*a* becomes small as much as possible.

Figure 5:
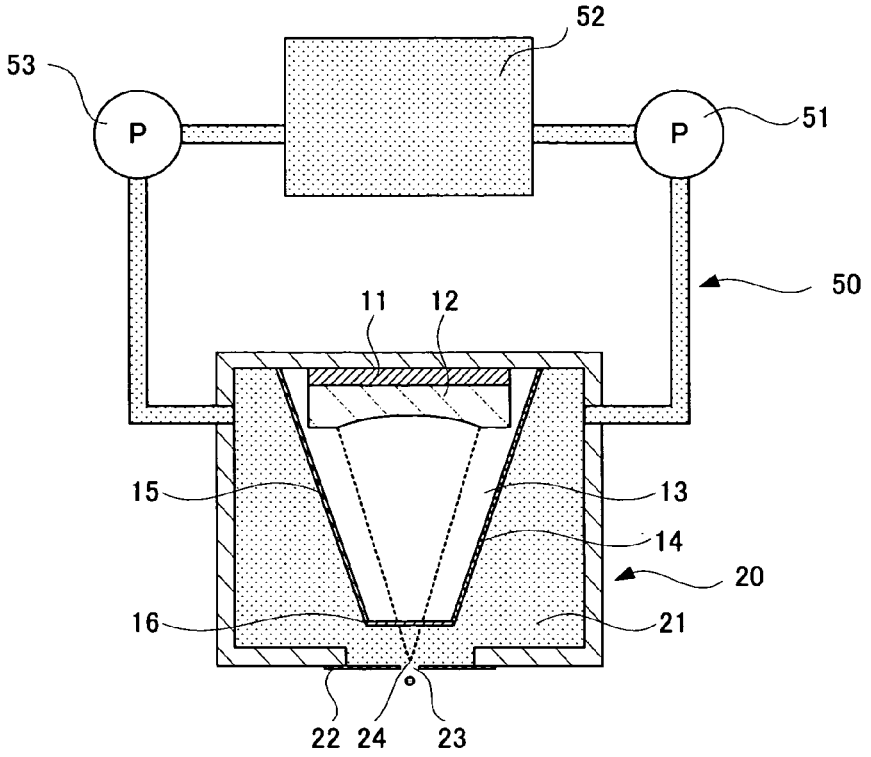
FIG. 5 is a sectional view of a single head portion according to a third embodiment of the present invention.
Figure 6:
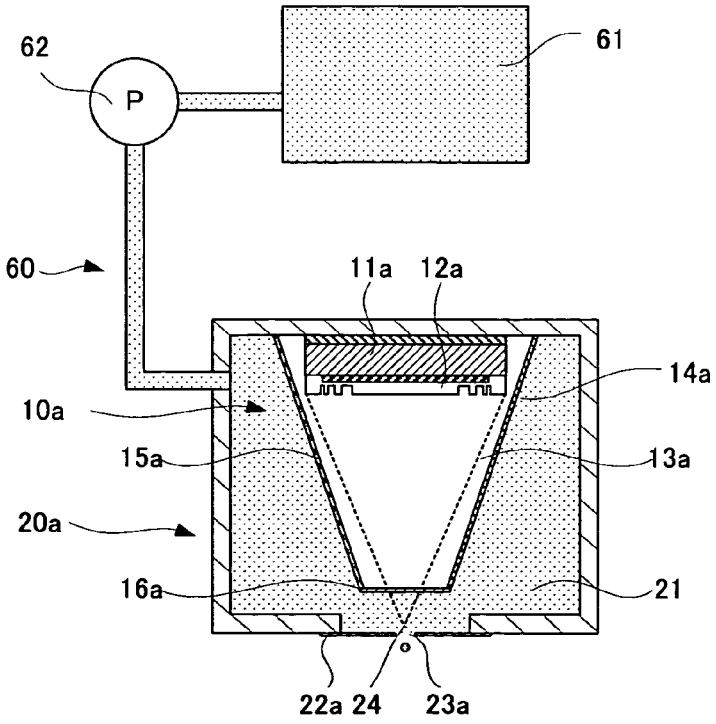
FIG. 6 is a sectional view of a phased array head portion according to a fourth embodiment of the present invention.

FIG. 5 is a view showing a configuration of a third embodiment according to the single head, and FIG. 6 is a view showing a configuration of a fourth embodiment according to the phased array head. The third embodiment is the one in which an ink circulation member 50 is provided to the first embodiment. The ink circulation member 50 is constituted by a pump 51 drawing the ink inside of the ink holding chamber 21 out of the ink chamber 20, an ink tank 52, and a pump 53 sending the ink from the ink tank 52 into the ink holding chamber 21 of the ink chamber 20. A not-shown temperature adjusting member constantly keeping the temperature of the ink drawn from the ink chamber 20 to be a desired temperature (for example, 20° C.) is provided at the ink tank 52. Further, a not-shown concentration adjusting member measuring a concentration of the ink and adjusting to be a desired concentration may be provided.

The fourth embodiment is the one in which an ink supply member 60 is provided in addition to the second embodiment. The ink supply member 60 is constituted by an ink tank 61 and a pump 62 supplying the ink from the ink tank 61 to the ink chamber 20*a*.

The ink circulation member 50 capable of adjusting the temperature is provided as in the third embodiment, and thereby, an effect to prevent a rising of the temperature of a whole head caused by heat generated by the ultrasonic wave generation member 11 can be obtained. Besides, in the fourth embodiment, the ink supply member 60 is provided, and thereby, an effect constantly keeping an amount of the ink inside of the ink chamber 20*a* to be proper quantity can be obtained. Besides, as it is described previously, heights of the head units 10, 10*a* provided inside of the ink chambers 20, 20*a* relative to the ultrasonic wave traveling direction are constituted to be smaller than depths of the ink chambers 20, 20*a* in a parallel direction with the ultrasonic wave traveling direction inside of the ink chambers 20, 20*a*. Accordingly, it is possible to supply the ink easily and evenly, because it is constituted such that the ink inside of the ink chambers 20, 20*a* is supplied to the ultrasonic wave focus point 24 portion not via the pore and so on, and without a pressure to send the ink. Further, not powerful but small-sized pumps become sufficient as the pumps 53, 62 sending the ink to the ink chambers 20, 20*a* if the container portions 14, 14*a* have a shape in which the area of the narrow portion (tip portion) between the isolation films 16, 16*a* and the slip plates 22, 22*a* becomes small.

In the above-stated third embodiment, the ink circulation member 50 is provided at the single head, but the ink supply member 60 may be provided at the single head. Besides, in the fourth embodiment, the ink supply member 60 is provided at the phased array head, but the ink circulation member 50 may be provided at the phased array head. Besides, the head is constituted to eject the ink toward downward in FIG. 5 and FIG. 6, but the ink may be ejected horizontally by rotating 90 degrees, or toward upward by rotating 180 degrees.

Figure 7:
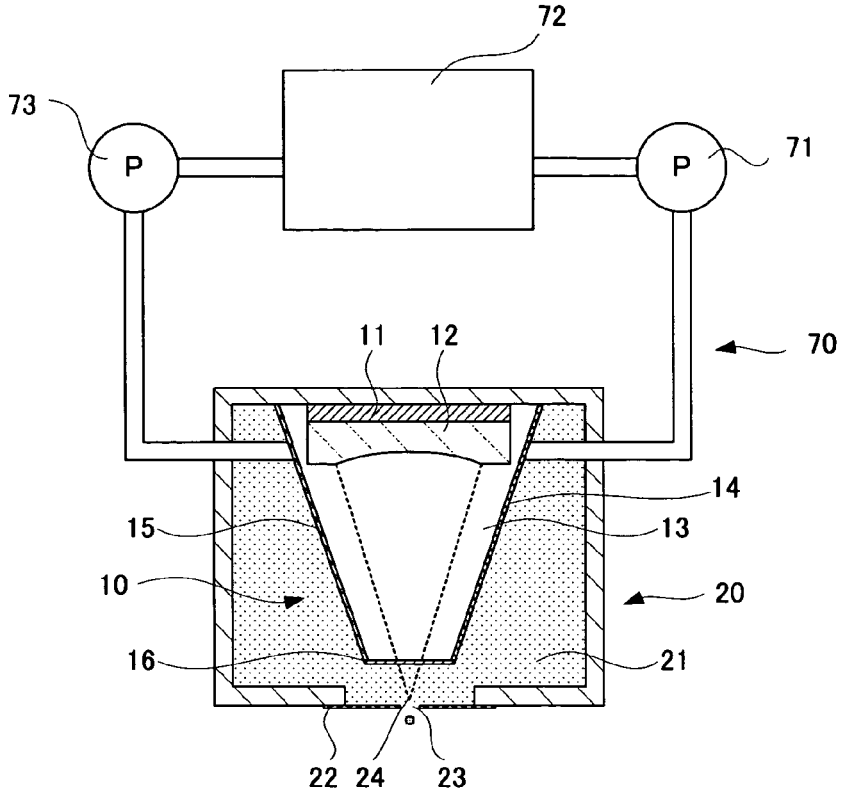
FIG. 7 is a sectional view of a single head portion according to a fifth embodiment of the present invention.
Figure 8:
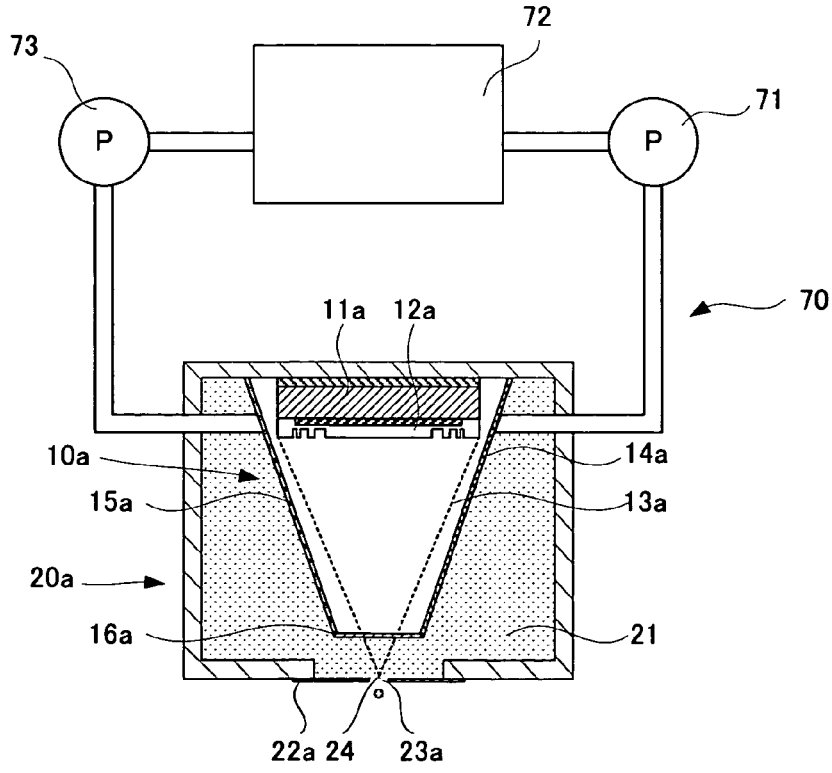
FIG. 8 is a sectional view of a phased array head portion according to a sixth embodiment of the present invention.

FIG. 7 is a view showing a configuration of a fifth embodiment according to the single head, and FIG. 8 is a view showing a configuration of a sixth embodiment according to the phased array head. The fifth embodiment is the one in which an ultrasonic wave propagation material circulation member 70 is provided to the first embodiment. Besides, the sixth embodiment is the one in which the ultrasonic wave propagation material circulation member 70 is provided to the second embodiment.

As shown in FIG. 7 and FIG. 8, the ultrasonic wave propagation material circulation member 70 is constituted by a pump 71 drawing the ultra sonic wave propagation material from inside of the ultrasonic wave propagation portions 13, 13*a* (container portions 14, 14*a*), an ultrasonic wave propagation material tank 72, and a pump 73 sending the ultrasonic wave propagation material into the ultrasonic wave propagation portions 13, 13*a*. The ultrasonic wave propagation material circulation member 70 is provided, and thereby, it becomes possible to keep a hydraulic pressure inside of the ultrasonic wave propagation portions 13, 13*a* to be the same constantly, and to keep a traveling of the ultrasonic wave into the same condition. Besides, a not-shown temperature adjusting member keeping the temperature of the ultrasonic wave propagation material drawn from the ultrasonic wave propagation portions 13, 13*a* to the ultrasonic wave propagation material tank 72 constantly to be a desired temperature (for example, 20° C.) may be provided. An effect to prevent a rising of the temperature of the whole head caused by the heat generated by the ultrasonic wave generation member 11 can also be obtained.

Incidentally, the head is constituted to eject the ink toward downward in FIG. 7 and FIG. 8, but the ink may be ejected horizontally by rotating 90 degrees, or toward upward by rotating 180 degrees.

Figure 9:
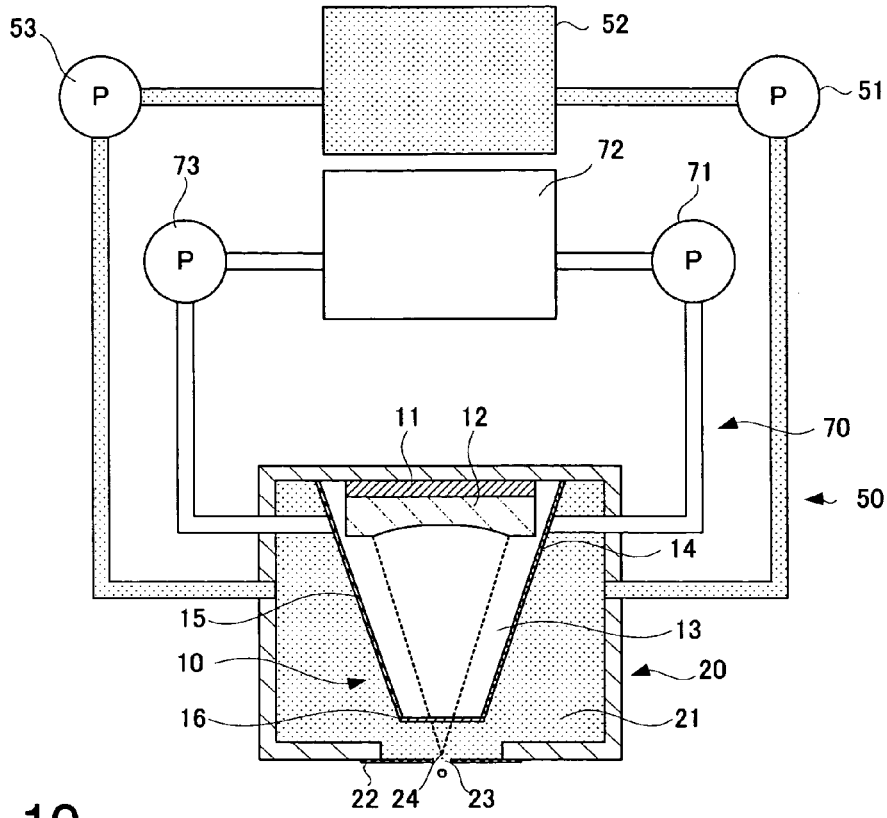
FIG. 9 is a sectional view of a single head portion according to a seventh embodiment of the present invention.
Figure 10:
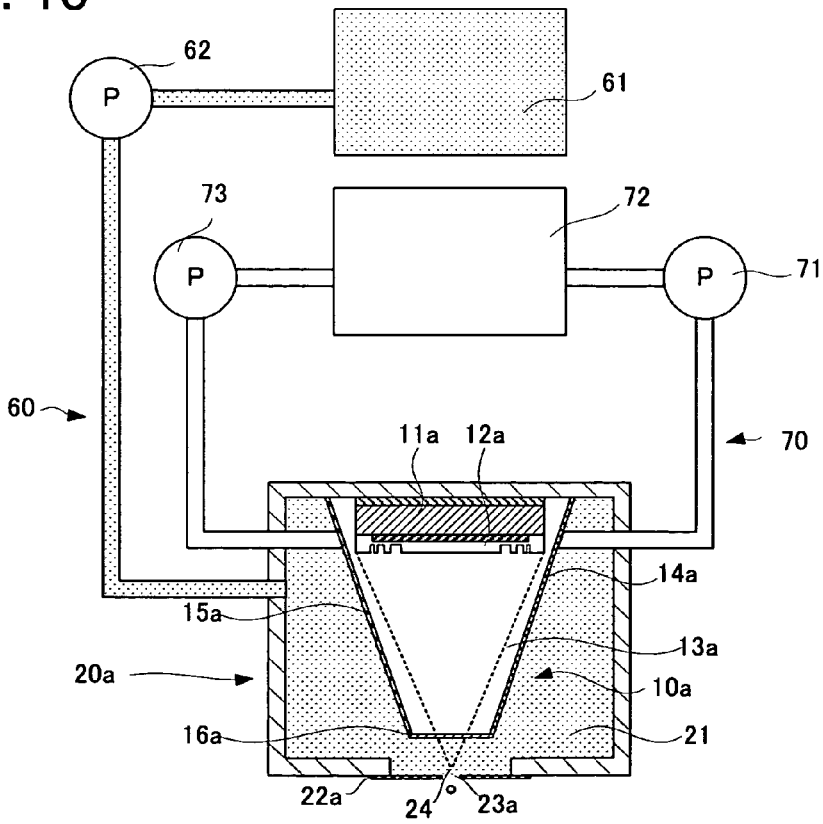
FIG. 10 is a sectional view of a phased array head portion according to an eighth embodiment of the present invention.

FIG. 9 is a view showing a configuration of a seventh embodiment according to the single head, and FIG. 10 is a view showing a configuration of a eighth embodiment according to the phased array head. The seventh embodiment is the one in which the ink circulation member 50 and the ultrasonic wave propagation material circulation member 70 are provided to the first embodiment. Besides, the eighth embodiment is the one in which the ink supply member 60 and the ultrasonic wave propagation material circulation member 70 are provided to the second embodiment. As in the above-stated seventh and eighth embodiments, both the ink circulation member 50 or the ink supply member 60, and the ultrasonic wave propagation material circulation member 70 may be provided, and the above-stated operations and effects can be obtained.

Incidentally, the head is constituted to eject the ink toward downward in FIG. 9 and FIG. 10, but the ink may be ejected horizontally by rotating 90 degrees, or toward upward by rotating 180 degrees.

Figure 11:
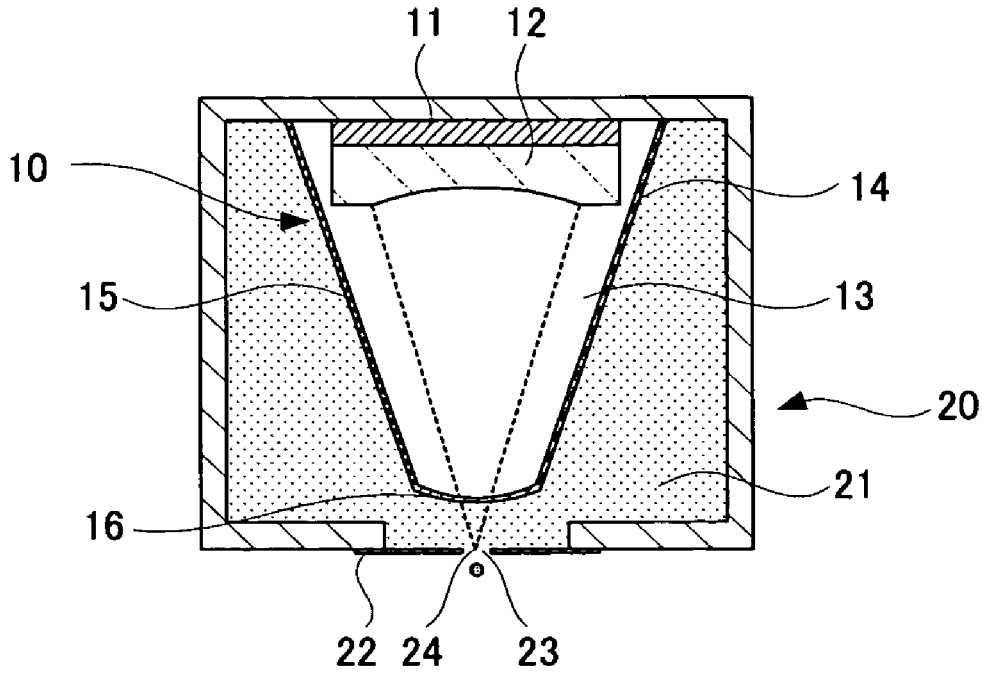
FIG. 11 is a view to explain a focus operation method of a head portion.

Next, a control method of the ultrasonic wave focus point 24 (focal point) of the head portion in the inkjet recording apparatus in the fifth to eighth embodiments are described with reference to FIG. 11. As it is described previously, the isolation film 16 of the head unit 10 is composed of the material of which shape is changeable (for example, polyethylene terephthalate (PET)), and it is possible to control the ultrasonic wave focus point 24 (focal point) by deforming the isolation film 16 (for example, a downward direction of the drawing or an upward direction of the drawing in FIG. 11).

A control of the deformation of the isolation film 16 can be realized by adjusting a pump pressure of the pump 73 of the above-stated ultrasonic wave propagation material circulation member 70 sending the ultrasonic wave propagation material to the ultrasonic wave propagation portion 13. Namely, the pump pressure of the pump 73 is turned up, then the hydraulic pressure of the ultrasonic wave propagation material relative to the isolation film 16 rises, and thereby, the isolation film 16 deforms in the downward direction in FIG. 11, and the ultrasonic wave focus point 24 (focal point) moves toward downward in accordance with the deformation of the isolation film 16. Further, the hydraulic pressure of the ultrasonic wave propagation material relative to the isolation film 16 is lowered by lowering the pump pressure of the pump 73, then the isolation film 16 deforms in the upward direction in FIG. 11, and the ultrasonic wave focus point 24 (focal point) moves toward upward in accordance with the deformation of the isolation film 16.

Generally, the ultrasonic wave attenuation of ink is large relative to the ultrasonic wave attenuation of the ultrasonic wave propagation material inside of the ultrasonic wave propagation portion 13. The speed of sound is influenced by the ultrasonic wave attenuation, and therefore, the ultrasonic waves generated at the ultrasonic wave generation member 11 is refracted at the isolation film 16 by the Snell's law, and a focus position changes. The focusing position is changed by using this property with corresponding to a deterioration of ink and so on caused by the inkjet, evaporation and so on, and thereby, it becomes possible to perform a good and stable recording. Besides, in case of the upward ejection, it is possible to correspond to a fine liquid surface fluctuation of ink as stated above.

The present invention is not limited to described contents in the above-stated embodiments, but it can be embodied by modifying components, materials, dispositions of respective members thereof within a range not departing from the spirit of the invention.

What is claimed is:

1. An inkjet recording apparatus, including:

an ink holding chamber having an opening portion so as to hold the ink inside thereof; and a head unit ejecting the ink held in the ink holding chamber from the opening portion, wherein the head unit comprises:

an ultrasonic wave generation member to generate ultrasonic waves;

a focusing member to focus the ultrasonic waves in a vicinity of the opening portion;

an ultrasonic wave propagation portion propagating the ultrasonic waves leaving the focusing member; and a container portion containing the ultrasonic wave generation member, the focusing member, and the ultrasonic wave propagation portion, and wherein the container portion comprises:

a sidewall portion disposed approximately in parallel with a traveling direction in which the ultrasonic waves leaving the focusing member travels; and an isolation film positioned on a traveling path of the ultrasonic waves focused by the focusing member, disposed to face the opening portion, and of which shape is changeable, wherein the ultrasonic wave propagation portion is composed of a liquid ultrasonic wave propagation material and includes an ultrasonic wave propagation material circulation member to circulate the ultrasonic wave propagation material, and wherein the ultrasonic wave propagation material circulation member has a hydraulic pressure adjusting member to adjust hydraulic pressure inside of the ultrasonic wave propagation portion, and to vary a position to focus the ultrasonic waves generated at the ultrasonic wave generation member by changing a shape of the isolation film by the hydraulic pressure adjusting member.

2. The apparatus according to claim 1, wherein the ultrasonic wave generation member includes piezoelectric materials formed in a one-dimensional array state.

3. The apparatus according to claim 2, wherein the focusing member is constituted by a flat Fresnel lens.

4. The apparatus according to claim 1, wherein the ink holding chamber includes an ink circulation member to circulate the ink held in the ink holding chamber.

5. The apparatus according to claim 1, wherein the ink holding chamber includes an ink supply member to supply the ink to the ink holding chamber.

* * * * *

UNITED STATES PATENT AND TRADEMARK OFFICE

CERTIFICATE OF CORRECTION

PATENT NO. : 7,997,694 B2
APPLICATION NO. : 11/902445
DATED : August 16, 2011
INVENTOR(S) : Nomura et al.

It is certified that error appears in the above-identified patent and that said Letters Patent is hereby corrected as shown below:

Title page, item (57), in the Abstract, line 8, change “propagateting” to --propagating--.

Signed and Sealed this
Twenty-ninth Day of November, 2011

David J. Kappos

David J. Kappos
*Director of the United States Patent and Trademark Office*